US010972829B2

(12) United States Patent
Yu et al.

(10) Patent No.: US 10,972,829 B2
(45) Date of Patent: Apr. 6, 2021

(54) PORTABLE SOUND EQUIPMENT

(71) Applicant: LG ELECTRONICS INC., Seoul (KR)

(72) Inventors: Hyunseung Yu, Seoul (KR); Dongsung Kim, Seoul (KR); Donguk Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/545,512

(22) Filed: Aug. 20, 2019

(65) Prior Publication Data

US 2020/0120411 A1 Apr. 16, 2020

(30) Foreign Application Priority Data

Oct. 15, 2018 (KR) ..... 10-2018-0122390

(51) Int. Cl.
*H04R 1/10* (2006.01)
*H04R 9/02* (2006.01)

(52) U.S. Cl.
CPC ..... *H04R 1/1075* (2013.01); *H04R 1/1016* (2013.01); *H04R 9/025* (2013.01); *H04R 2420/07* (2013.01)

(58) Field of Classification Search
None
See application file for complete search history.

(56) References Cited

U.S. PATENT DOCUMENTS

2014/0056455 A1* 2/2014 Sakaguchi ..... H04R 1/2811 381/328
2016/0267898 A1* 9/2016 Terlizzi ..... H04R 1/1083
2016/0267899 A1* 9/2016 Gauger, Jr. ..... H04R 3/005

FOREIGN PATENT DOCUMENTS

KR 10-1469907 B1 12/2014
KR 10-1558091 B1 10/2015
KR 10-2016-0149478 A 12/2016
KR 10-2017-0030366 A 3/2017
KR 10-2017-0125050 A 11/2017

* cited by examiner

*Primary Examiner* — Kenny H Truong
(74) *Attorney, Agent, or Firm* — Birch, Stewart, Kolasch & Birch, LLP

(57) ABSTRACT

A portable sound equipment including a housing having an audio hole; an inner microphone collecting a sound through the audio hole; an audio output unit having a frame securing a speaker in which a ventilation hole is formed in the frame allowing outside air to pass through the audio output unit, and a mesh covering the ventilation hole and having a density sufficient to reduce an amount of the outside air passing through the audio output unit; and a controller processing the sound collected by the inner microphone.

8 Claims, 9 Drawing Sheets

(a)

(b)

PORTABLE SOUND EQUIPMENT

CROSS-REFERENCE TO RELATED APPLICATION

Pursuant to 35 U.S.C. § 119(a), this application claims the benefit of an earlier filing date and priority to Korean Application No. 10-2018-0122390 filed in the Republic of Korea on Oct. 15, 2018, the entire contents of which is hereby incorporated by reference in its entirety.

BACKGROUND OF THE INVENTION

Field of the Invention

The present invention relates to a portable sound device that receives a sound signal from a terminal through wireless communication with the terminal and transmits a control signal for controlling the terminal to the terminal.

Discussion of the Related Art

A portable sound device receives a sound signal from a terminal and transmits information about a sound collected through a microphone to the terminal. Conventional portable sound devices use a wired mode, in which a portable sound device is connected to a terminal through an ear jack in order to receive a sound signal from the terminal. In recent years, however, the demand for a wireless communication type portable sound device has been increased due to the convenience in mobility and use thereof.

A portable sound device has an audio output module, through which music can be played and a telephone conversation can be performed. The portable sound device may be connected to a base station in order to have a telephone conversation, may be directly connected to an external server in order to acquire sound data, and may be connected to a terminal in order to perform the above functions through pairing.

Various types of portable sound devices based on the portability thereof, such as a headphone-type portable sound device, which is placed on the head of a user in the form of a hair band such that the user can carry the portable sound device, an ear-hanging type portable sound device, and an in-ear type portable sound device, have been developed.

A portable sound equipment collects user's voice through a microphone and then stores or delivers the collected voice to a counterpart on the line as well as outputs sound. Further, in order to distinguish the user's voice from external noise, various algorithms are used and a plurality of microphones are physically disposed at optimal locations as far as possible. However, as a portable sound equipment tends to be downsized so as to put some limitations on microphone disposition, it is difficult to collect optimal sound.

SUMMARY OF THE INVENTION

Accordingly, the present invention is directed to a portable sound equipment that substantially obviates one or more problems due to limitations and disadvantages of the related art.

One object of the present invention is to provide a portable sound equipment.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a portable sound equipment according to one embodiment of the present invention may include a housing having an audio hole formed in one side, an audio output unit outputting a sound through the audio hole, an inner microphone collecting a sound through the audio hole, and a controller installed in the housing, the controller configured to control the audio output unit to output the sound and process the sound collected by the inner microphone, the audio output unit including a frame, a vibration plate located at one side of the frame, an audio coil located within the frame, a permanent magnet generating a magnetic field around the audio coil, a signal line connecting the audio coil and the controller to each other, an airing hole located in the other side of the frame so as to connecting an inside and an outside of the frame to each other, and a mesh covering the airing hole.

Accordingly, a portable sound equipment according to an embodiment of the present invention further includes an inner microphone configured to collect a sound input through a user's body, thereby removing an external noise more effectively.

Moreover, the present invention prevents an external noise introduced through an airing hole of an audio output unit from entering an inner microphone, thereby collecting user's clear voice.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and wherein.

DETAILED DESCRIPTION OF THE INVENTION

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Although the terms first, second, etc. may be used herein to describe various elements, these elements should not be limited by these terms. These terms are generally only used to distinguish one element from another. When an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Figure 1:
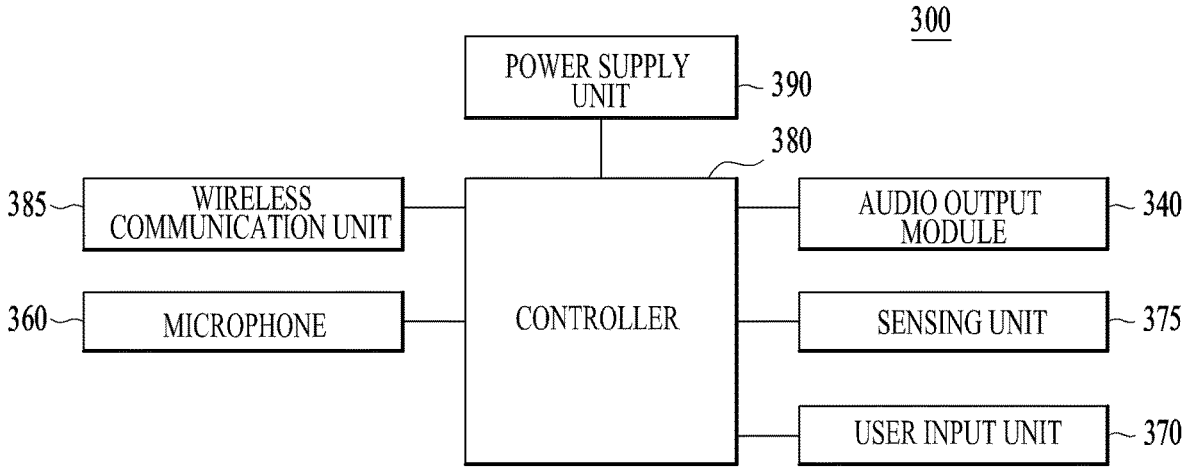
FIG. 1 is a block diagram showing the structure of a portable sound device according to an embodiment of the present invention.
Figure 2:
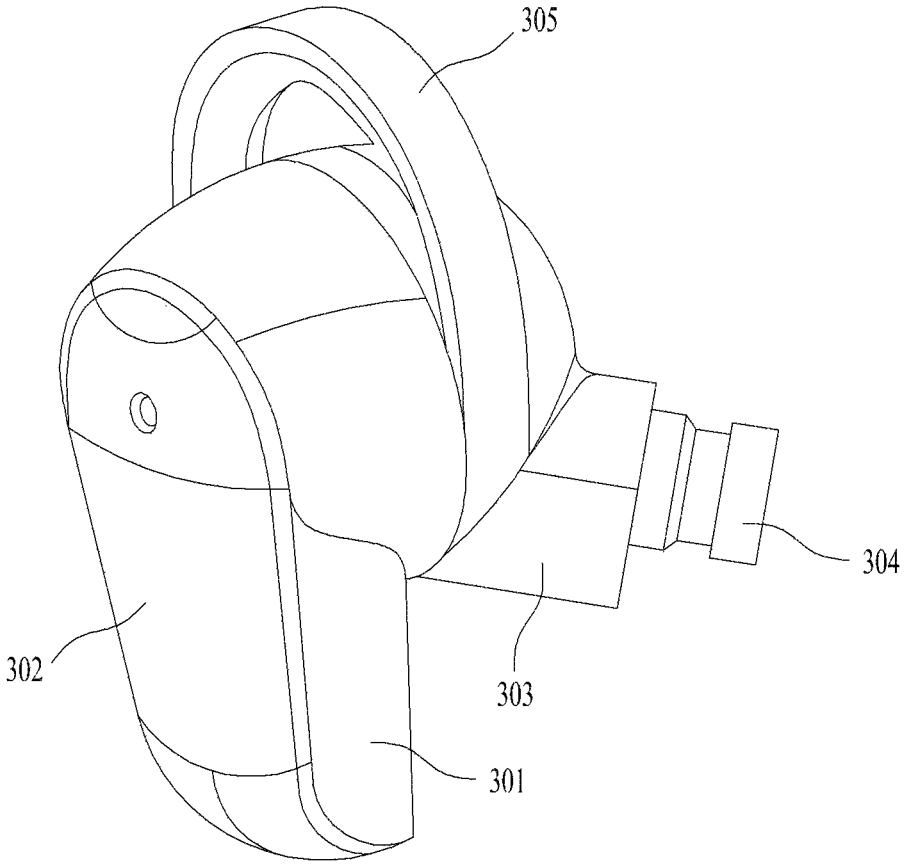
FIG. 2 is a perspective diagram of a portable sound equipment according to one embodiment of the present invention, viewed in one direction.
Figure 3:
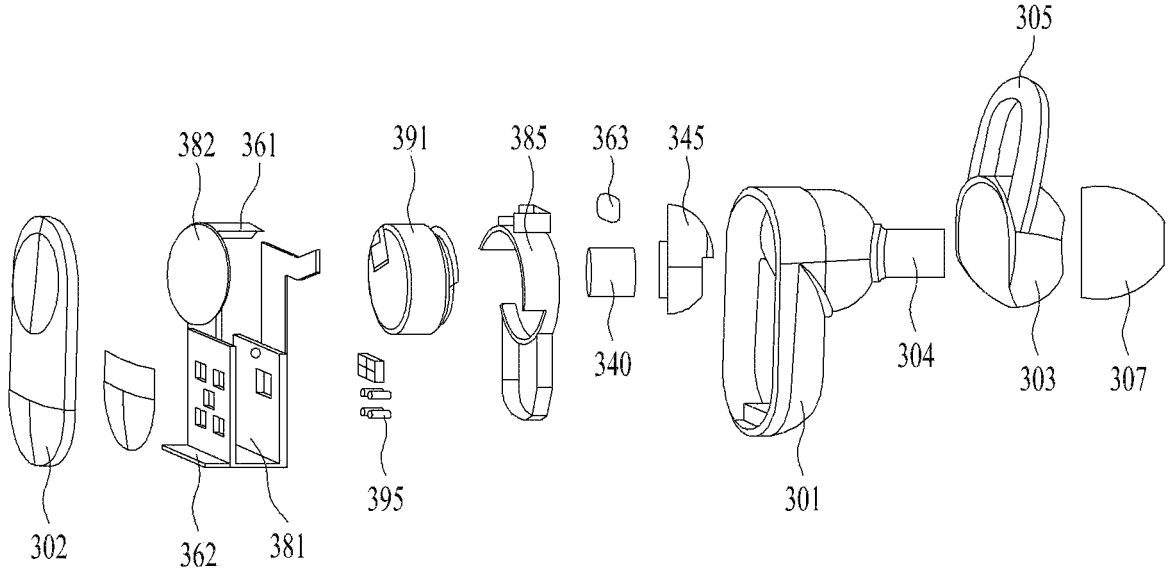
FIG. 3 is an exploded perspective diagram of a portable sound equipment according to one embodiment of the present invention.

FIG. 1 is a block diagram of a portable sound equipment 300 according to one embodiment of the present invention, FIG. 2 is a perspective diagram of a portable sound equipment 300 according to one embodiment of the present invention, viewed in one direction, and FIG. 3 is an exploded perspective diagram of a portable sound equipment 300 according to one embodiment of the present invention. For clarity of description of the components of the portable sound equipment 300 related to FIGS. 1-3 are referred to as well.

The portable sound device 300 according to the embodiment of the present invention includes a controller 380, a wireless communication unit 385, an audio output module 340, a sensing unit 375, a microphone 360, a user input unit 370, and a power supply unit 390. The portable sound equipment 300 of the present invention includes a plurality of cases 301 to 303. And, the cases are joined together to form a housing including an inner space in which electronic parts are installed. The second case 302 joined to one side of the first case 301 is a part exposed externally when a user wears the portable sound equipment 300, and the audio output unit 340 is located at the other side of the first case 301 so as to output a sound according to an audio signal, whereby an audio passage 304 is formed to deliver a sound to the user. In order to facilitate installation of a part (e.g., audio output unit) in the first case 301, a part at which the audio passage 304 is located may be separated to configure a separate case 303.

The portable sound equipment 300 is a kernel type and includes an audio passage 304 projected in form insertable in user's external auditory meatus. In addition, an ear tip 307 may be joined to an outside of the audio passage 304 so as to adhere to user's ear.

The microphone 360 processes an external audio signal into electrical audio data. The processed audio data is delivered to an external terminal or server through the wireless communication unit 385. Various noise elimination algorithms for eliminating noise generated in the course of receiving an input of the external audio signal can be implemented in the microphone 360.

Figure 4:
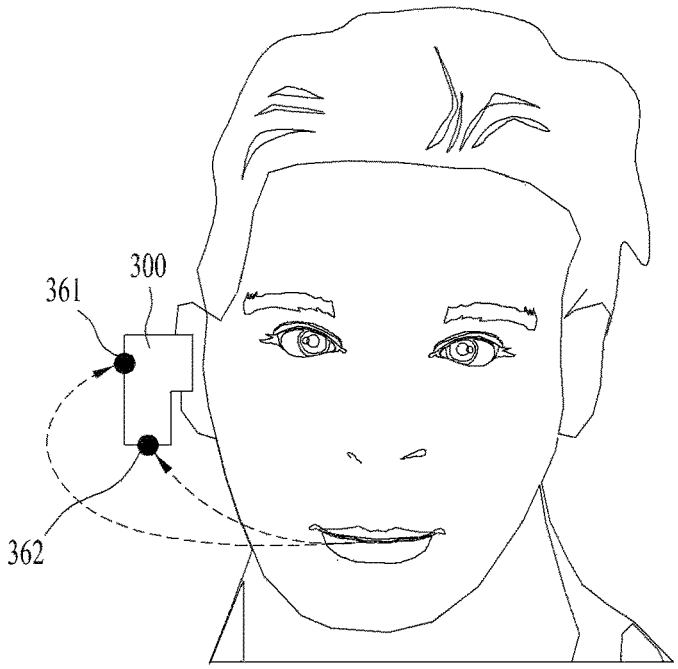
FIG. 4 is a diagram illustrating a method of collecting user's speech sound through a plurality of microphones.
Figure 4:
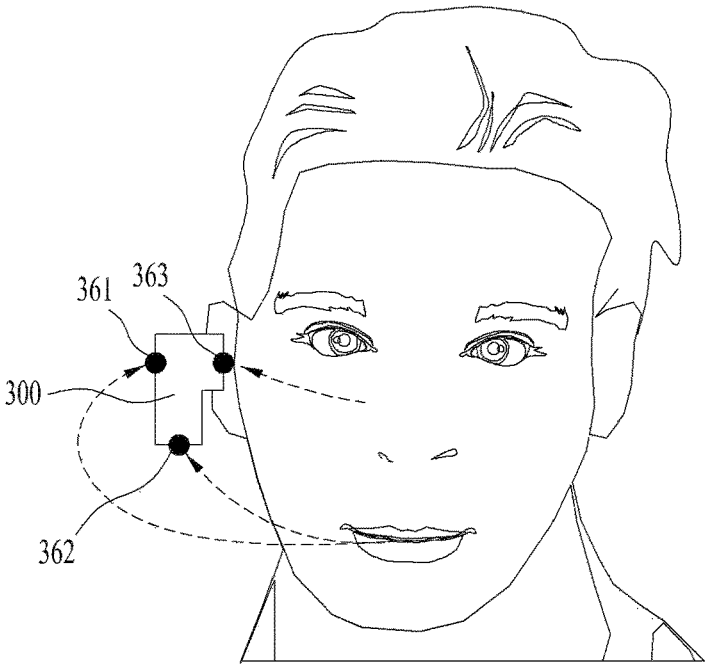

Next, FIG. 4 is a diagram illustrating a method of collecting user's speech sound through a plurality of microphones. In particular, FIG. 4 (*a*) shows a case that 2 microphones are provided, and FIG. 4 (*b*) shows a case that 3 microphones are provided.

According to an embodiment of the present invention, a plurality of microphones 360 are provided so as to eliminate noise by combining various sounds. Referring to FIG. 4 (*a*), as 2 microphones 361 and 362 are disposed at different locations, respectively, a user's speech sound and an external noise can be distinguished from each other using a time difference, a volume difference and the like between the sounds collected by the microphones 361 and 362, respectively.

Furthermore, referring to FIG. 4 (*b*), a third microphone 363 configured to collect a sound transmitted through the Eustachian tube connecting the user's mouth and ear to each other is additionally provided, thereby eliminating an external noise by combining sounds collected by the externally located microphones 361 and 362 and the third microphone 363. Particularly, in the sound collected by the third microphone 363, an external noise is collected as the smallest and a user's voice collected as the largest, whereby a structure optimal for eliminating the external noise can be provided.

In addition, the sensing unit 375 recognizes the state of the portable sound device 300 and the surroundings of the portable sound device 300. In more detail, the sensing unit 375 may include an illuminance sensor for sensing brightness around the portable sound device 300, a touch sensor for sensing a touch input, and a gyro sensor for sensing the tilt and position of the portable sound device 300.

Further, the user input unit 370 is for a user to control the portable sound equipment 300. The portable sound equipment 300 in small size like the present invention combines a button pressed time, a button pressed count, and a plurality of buttons using a touch mechanism or the limited number of buttons, thereby extending a corresponding input to an inputtable control command.

In addition, the power supply unit 390 supplies necessary power to the controller and various parts and may use a button type battery 391 to install in a small space. As a size of the battery 391 determines a use time of the portable sound equipment 300, it is preferable to secure a space as large as possible. Hence, it possible to enlarge an installable space by overlaying some boards on each other. In order to charge the battery 391, a power terminal for connection to an external power source may be included. The power terminal comes into contact with a power terminal formed in a cradle on which the portable sound equipment 300 is mounted, thereby receiving a power from the external power source.

A printed circuit board 381 is located as the controller 380 within the housing. As a plurality of Integrated Circuits (ICs) are mounted on the printed circuit board 381, if the printed circuit board 381 is disposed by overlapping with the battery 391, it causes a problem that an overall thickness is increased. Hence, the printed circuit board 381 is disposed not to overlap with the battery 391 and may use a flexible board 382 for installation and connection of some components such as the microphone 360, the user input unit 370, the audio output unit 340 and the like.

The wireless communication unit 385 means a device for wireless communication with another terminal or a base station and may include an antenna for transmission/reception of wireless signals. If the antenna touches a user's body, radiation performance is degraded. Hence, the antenna may be located in the second case 302 failing to come into contact with the user's body in case of wearing the portable sound equipment 300.

A main bracket 385 may be used to fix the flexible board 382, the printed circuit board 381, the battery 391, the microphone and the like. The printed circuit board 381, the battery 391, the flexible board 382, the microphones 361 and 362 and the like are installed in the main bracket 385, joined into a single assembly, and then installed in the housing. Thus, they can be easily installed in the housing.

Figure 5:
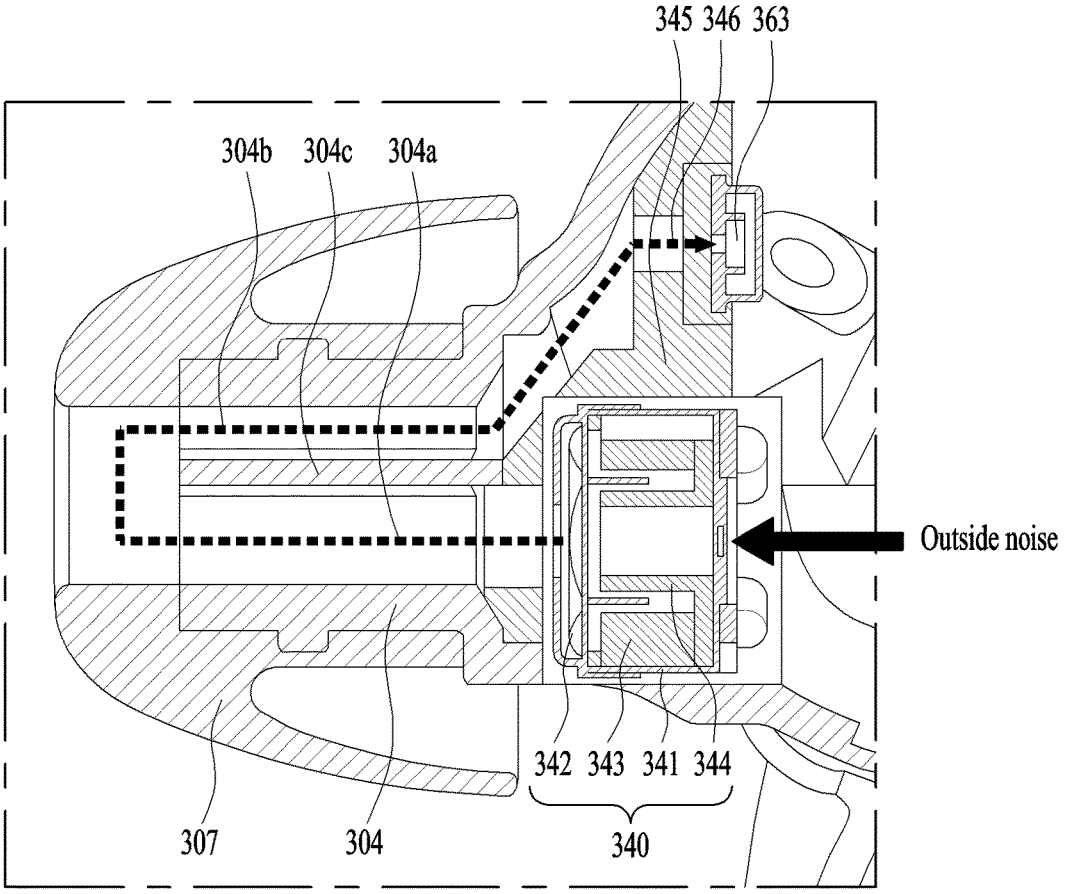
FIG. 5 is a diagram illustrating that an external noise enters a third microphone.

Next, FIG. 5 is a diagram illustrating an external noise entering a third microphone. A sound transmitted through the user's Eustachian tube may pass through the audio passage 304 and then arrive at the third microphone 363. Hence, the third microphone 363 can be disposed within the audio passage 304 as well as the audio output unit 340.

However, if a sound output from the audio output unit 340 enters the third microphone 363, it causes a problem that a sound collected by the third microphone 363 is mixed with a noise. By forming a partition 304*c* in the audio passage, as shown in FIG. 5, the audio passage can be divided into a first audio passage 304*a* and a second audio passage 304*b*. Thus, the audio passage 304 can be partitioned in a manner as follows. First of all, a sound output from the audio output unit 340 is output along the first audio passage 304*a*. Secondly, a user's voice arrives at the third microphone 363 through the second audio passage 304*b*.

Thus, if the audio passage 304 is divided by the partition 304*c*, it is advantageous in that a noise caused by a sound output from the audio output unit 340 can be reduced in a sound collected by the third microphone 363. If the thickness of the partition 304*c* increases, the output from the audio output unit 340 can be prevented from entering the third microphone 363 to the minimum. Yet, since the audio passage 304 may become excessively narrow, the thickness of the partition 304*c* can be set in consideration of both aspects. A cross section of the first audio passage 304*a* may be formed twice greater than that of the second audio passage 304*b*, whereby the sound output from the audio output unit 340 can escape therefrom sufficiently.

An audio bracket 345 may be further provided so that the audio output unit 340 and the microphone 363 can be accurately disposed in the first audio passage 304*a* and the second audio passage 304*b*. The audio bracket 345 includes a hole connected to the first audio passage 304*a* and the second audio passage 304*b*. As shown in FIG. 5, regarding the third microphone 363 connected to the second audio passage 304*b*, an auxiliary audio passage 346 may be provided to the audio bracket 345 so as to be connected to the location of the third microphone 363.

The audio output unit 340 may include a frame 341, a vibration plate 342 located on one side of the frame 341, an audio coil 343 located within the frame 341, and a permanent magnet 344 generating a magnetic field around the audio coil 343. If a power is applied to the audio coil 343, an electromagnetic force is generated within the magnetic field generated by the permanent magnet 344 so as to move the audio coil 343. As the audio coil 343 is moved, the vibration plate 343 vibrates so as to output a sound.

When the vibration plate 342 is moved, if an inside of the frame 341 becomes airtight, the movement of the vibration plate 342 is limited. Hence, an airing hole 3412 (see FIG. 6) through which air can pass is provided for the frame 341. Generally, the airing hole 3412 for ventilation is formed in the other side of the frame 341 opposite to the vibration plate 342.

Yet, as shown in FIG. 5, an external noise may flow in through the airing hole 3412 located in the other side of the audio output unit 340. In this instance, it is difficult to collect a user's voice only without an external noise using the third microphone 363. If the external noise is collected as well, the external noise may be determined as the user's voice so as to make it difficult to eliminate the noise. Thus, it is preferable to reduce the external noise flowing in through the audio output unit 340 as small as possible.

Figure 6:
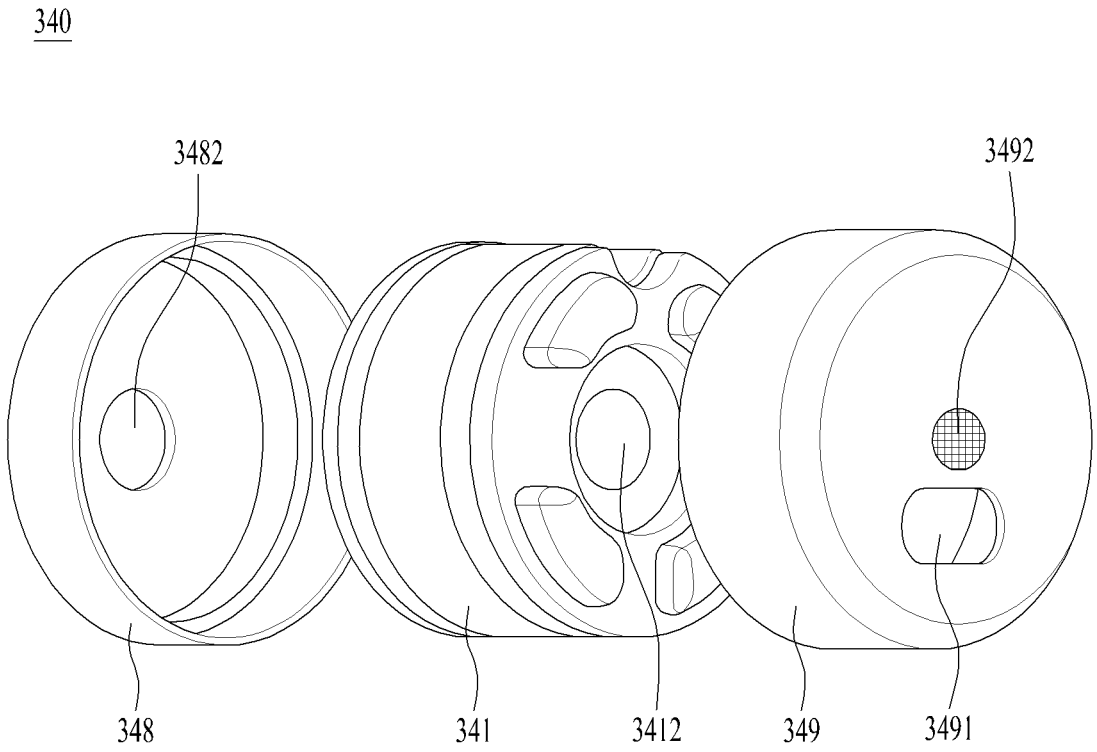
FIG. 6 is a diagram showing an audio output unit of the present invention.

FIG. 6 is a diagram showing the audio output unit 340 of the present invention. Referring to FIG. 6, the audio output unit 340 located in the middle has the structure configured with the frame 341, the audio coil 343 and the permanent magnet 344 like the former audio output unit 340 shown in FIG. 5 and includes the airing hole 3412 formed in the other side of its own so as to enable air to flow therethrough. On the other side of the audio output unit 340, a signal cable for transmitting an audio signal to the audio coil 343 may be extended from a circumference of the airing hole 3412 by penetrating the frame 341.

It is possible to decrease a size of the airing hole 3412 in order to reduce an external noise. However, if the size of the airing hole 3412 is too small, it is difficult for air to pass through the airing hole 3412. Hence, it causes a problem that output performance of a speaker is degraded. Accordingly, one embodiment of the present invention reduces an external noise flowing in through the airing hole 3412 using a mesh 3492 configuring to cover the airing hole 3412.

The mesh 3492 may be directly joined to the airing hole 3412. Instead, without a structural change of the audio output unit 340, the airing hole 3412 can be covered with the mesh 3492 by joining a first cap 349 having the mesh 3492 to the other side of the frame 341. The mesh 3492 is located at a back hole formed in the first cap 349. And, a size of the back hole is formed smaller than that of the airing hole 3412, whereby a level of noise flowing in through the airing hole 3412 can be further lowered.

In addition, the first cap 349 may further include a cable hole 3491 through which a signal line for transmitting an audio signal to the audio coil 343 can pass. The signal line having passed through the cable hole 3491 can prevent the external noise from flowing in through the cable hole 349 by sealing a space between the cable hole 3491 and the signal line with a sealing part.

The first cap 349 may be directly joined to the frame 341. Instead, as shown in FIG. 6, the first cap 349 can be fixed in a manner that a second cap 348 located in a direction of one side of the frame 341 is joined to the first cap 349. The second cap 348 may include a front hole 3482 formed therein so that a sound output through vibration of the vibration plate 342 can pass through the front hole 3482.

Figure 7:
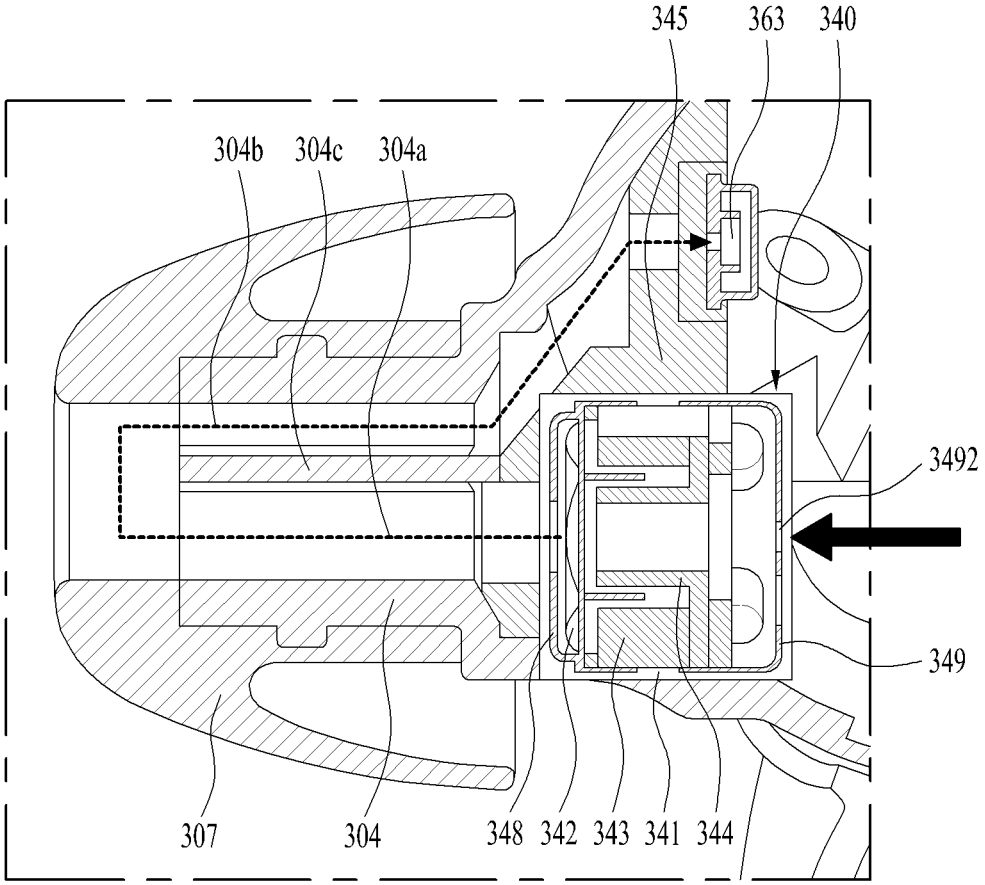
FIG. 7 is a diagram illustrating the movement of an external noise in a portable sound equipment including an audio output unit of the present invention.

FIG. 7 is a diagram illustrating the movement of an external noise in the portable sound equipment including the audio output unit 340 of the present invention. When the mesh 3492 shown in FIG. 6 is further provided, an external noise is cut off so that a sound entering the third microphone 363 can be reduced.

Figure 8:
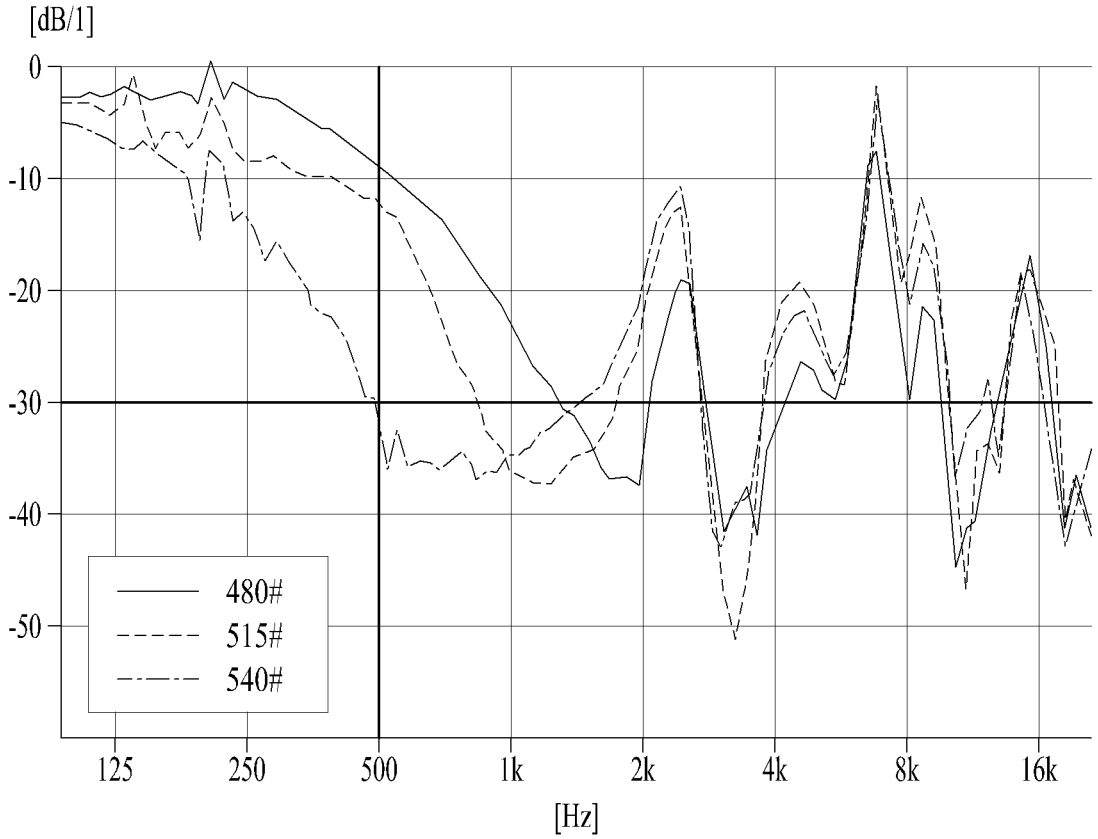
FIG. 8 is a graph showing a cutoff level of an external noise in a portable sound equipment including an audio output unit of the present invention.

If the density of the mesh 3492 is raised, the sound entering the third microphone 363 can be reduced. In more detail, FIG. 8 is a graph showing a cutoff level of an external noise in a portable sound equipment including an audio output unit of the present invention. The mesh 3492 is woven fabric and may be formed in a manner that a plurality of threads cross each other. And, the density of the mesh 3492 is represented with reference to the number of threads passing per unit area. For the test of the mesh 3492, weave density coefficients #480, #515 and #540 are used. The greater the coefficient, the higher the density of the mesh 3492 becomes.

In the graph, a horizontal axis indicates a frequency of sound and a vertical axis means a level of sound. A lower location means better cutoff performance. In addition, the mesh 3492 of the weave density coefficient #540 can be used indicating the cutoff performance under −30 dB with reference to a sound of 500 Hz.

Figure 9:
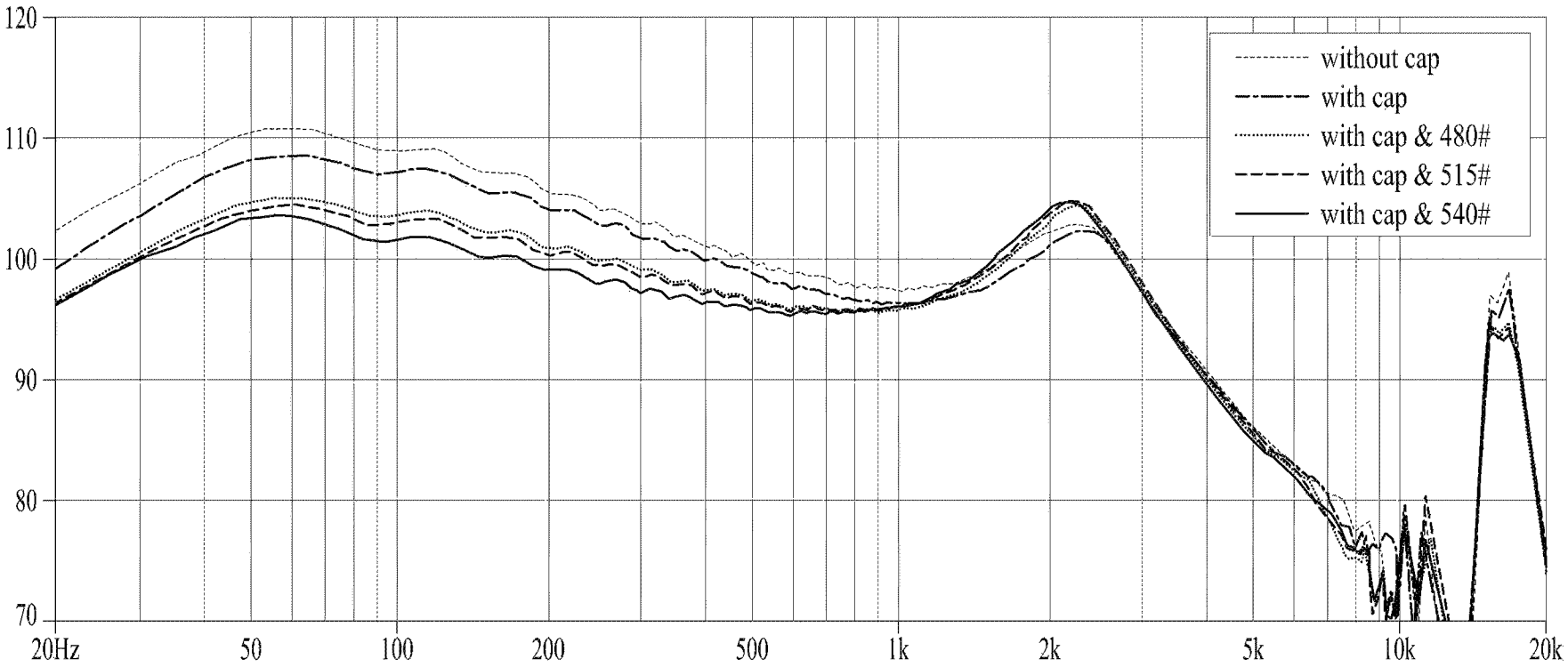
FIG. 9 is a graph showing a quality of a sound output from a speaker of in a portable sound equipment including an audio output unit of the present invention.

FIG. 9 is a graph showing a quality of a sound output from a speaker of in a portable sound equipment including an audio output unit of the present invention. If the mesh 3492 is employed, external noise can be cut off advantageously. Yet, output performance of the audio output unit 340, and more particularly, an output of a sound of a low-pitched tone band (1 kHz or below) is lowered.

When employing a cap only without the mesh 3492 with reference to audio output performance (without cap) in the state of not employing the first cap 349 in FIG. 5, as an amount of air entering the airing hole 3412 is reduced by a size of the back hole, performance of the audio output unit 340 is lowered a little. When employing the mesh 3492, as the density of the mesh 3492 increases, audio output performance decreases but a difference is insignificant. When the weave density coefficient #540 like the example shown in FIG. 8, the cutoff performance of the external noise is excellent. Therefore, the mesh 3492 of the weave density coefficient #540 can be used.

Accordingly, as described above, the portable sound equipment of the present invention further includes the microphone 363 configured to collect sounds input through a user's body, thereby eliminating the external noise more effectively. In addition, the present invention prevents the external noise flowing in through the back hole of the audio output unit 340 from entering the third microphone 363, thereby collecting user's clear voice.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A portable sound equipment, comprising:

a housing having an audio hole formed in one side;

an audio output unit outputting a sound through the audio hole;

an inner microphone collecting a sound through the audio hole; and a controller installed in the housing, the controller configured to control the audio output unit to output the sound and process the sound collected by the inner microphone, the audio output unit, comprising:

a frame;

a vibration plate located at one side of the frame;

an audio coil located within the frame;

a signal line connecting the audio coil and the controller to each other;

a permanent magnet generating a magnetic field around the audio coil;

an airing hole located in the other side of the frame so as to connect an inside and an outside of the frame to each other and allow outside air to pass through the audio output unit;

a first cap covering the other side of the frame;

a cable hole formed in the first cap so as to let the signal line to pass therethrough;

a sealing part sealing a space between the cable hole and the signal line;

a back hole formed in the first cap; and a mesh located at the back hole.

2. The portable sound equipment of claim 1, wherein a size of the back hole is smaller than that of the airing hole.

3. The portable sound equipment of claim 1, wherein the mesh comprises fabric.

4. The portable sound equipment of claim 1, wherein a cutoff performance of a sound flowing in through the mesh is equal to or greater than 30 dB on 500 Hz band.

5. The portable sound equipment of claim 1, wherein the audio hole is located at an end portion of an audio passage projected from one side of the housing and further comprises a partition dividing the audio passage into a first audio passage connected to the audio output unit and a second audio passage connected to the inner microphone.

6. The portable sound equipment of claim 5, wherein the first audio passage is larger than the second audio passage.

7. The portable sound equipment of claim 1, further comprising:

at least one outer microphone located at the other side of the housing, wherein the controller distinguishes a user's voice and an external noise from each other using a difference between the sound collected by the inner microphone and the sound collected by the outer microphone.

8. The portable sound equipment of claim 1, wherein the audio output unit further comprises:

a second cap located at one side of the vibration plate, the second cap comprising a front hole through which a sound output from the vibration plate is output.

* * * * *